US006629496B1

(12) United States Patent
Bööse et al.

(10) Patent No.: US 6,629,496 B1
(45) Date of Patent: Oct. 7, 2003

(54) DEVICE FOR END SEALING OF CHAMBERED DOCTOR BLADE

(76) Inventors: Åke Bööse, Laxvägen 3, SE-181 30 Lidingö (SE); Jan Stenqvist, Mosshult 3580, SE-260 60 Kvidinge (SE)

( * ) Notice: Subject to any disclaimer, the term of this patent is extended or adjusted under 35 U.S.C. 154(b) by 0 days.

(21) Appl. No.: 09/980,964

(22) PCT Filed: Jun. 26, 2000

(86) PCT No.: PCT/SE00/01347

§ 371 (c)(1),
(2), (4) Date: Dec. 4, 2001

(87) PCT Pub. No.: WO01/02169

PCT Pub. Date: Jan. 11, 2001

(30) Foreign Application Priority Data

Jul. 6, 1999 (SE) ..... 9902582

(51) Int. Cl.[7] ..... B41F 31/02
(52) U.S. Cl. ..... 101/363; 101/366; 101/350.6
(58) Field of Search ..... 101/363, 350.6, 101/366, 364; 118/261

(56) References Cited

U.S. PATENT DOCUMENTS 4,581,995 A * 4/1986 Stone ..... 101/366
4,821,672 A 4/1989 Bruno
5,125,341 A 6/1992 Yaeso
5,243,907 A * 9/1993 Weishew ..... 101/208
5,410,961 A * 5/1995 DeNicola et al. ..... 101/363
5,596,927 A 1/1997 Maurer et al.
5,662,042 A * 9/1997 Compton et al. ..... 101/483

FOREIGN PATENT DOCUMENTS

DE 94 05 883 7/1994
WO WO 93/24328 12/1993

* cited by examiner

*Primary Examiner*—Andrew H. Hirshfeld
*Assistant Examiner*—Leo T. Hinze
(74) *Attorney, Agent, or Firm*—Merchant & Gould P.C.

(57) ABSTRACT

A device is designed to sealingly close an end of a chambered doctor blade (K). The chambered doctor blade (K,) has an elongate frame (K1) and two elongate doctor blades (K6, K7), which are arranged on the frame (K1) and define, together with the latter, an elongate chamber (K10), which is adapted to hold, for instance, ink. The chambered doctor blade (K) has an elongate opening (K11) for abutment, in an operative position of the chambered doctor blade (K), against a rotatable cylinder (V) included in a printing unit. The end sealing device comprises first and second sealing sheets (20, 30) which are mountable to at least partially overlap each other and sealingly close an opening (K11) in one end of said chamber (K10). The sealing sheets (20, 30) are arranged relative to each other in such manner that the first sealing sheet (20) is sealingly applicable against said frame (K1) and, in the operative position of the chambered doctor blade (K), is located at a distance from a circumferential surface of said cylinder (V) and in such manner that the second sealing sheet (30) is sealingly applicable against said doctor blades (K6, K7), and, in the operative position of the chambered doctor blade (K), abuts against said circumferential surface.

23 Claims, 4 Drawing Sheets

DEVICE FOR END SEALING OF CHAMBERED DOCTOR BLADE

FIELD OF THE INVENTION

The present invention relates to a device for end sealing in a chambered doctor blade device, in the following also referred to as chambered doctor blade, for a printing unit, of the type defined in the preamble to appended claim 1. In addition, the invention relates to a chambered doctor blade having at least one such end sealing device.

BACKGROUND ART

Chambered doctor blades are extensively used in rotary-printing units, especially flexoprinting units, for applying ink, lacquer, adhesive or the like to a rotatable cylinder included in the printing unit. In a flexoprinting unit, the chambered doctor blade serves to ink a screen roller. This occurs by filling the cells or recesses of the roller with ink by means of the chambered doctor blade. Such a chambered doctor blade device is disclosed in, for example, WO 93/24328. Chambered doctor blades of this type comprise an elongate frame with two elongate doctor blades which are arranged alongside the roller in such manner that the longitudinal axis of the chambered doctor blade is parallel with that of the roller. The chambered doctor blade defines an elongate chamber which holds, for example, ink. When applying ink or the like to the circumferential surface of the roller, the chambered doctor blade is applied against the same. The function of each doctor blade changes with the direction of rotation of the roller. One of the doctor blades, the wiping doctor blade, wipes off excess ink while the other merely has a sealing function.

In the above construction, seals are required at the ends of the chambered doctor blade in order to laterally enclose the liquid in the chamber. Such end seals, which are adapted to seal internally against the chambered doctor blade and against the circumferential surface of the rotating cylinder, advantageously comprise flexible sealing means made of, for example, rubber or foamed plastic material. The drawback of these sealing means is that they are thick and thus abut against a significant part of the doctor blades, which means that ink can be accumulated and dry between the sealing means and the edges of the doctor blades, which in turn causes a deteriorated function of the doctor blades. Moreover this type of sealing means has a short service life.

To cope with some of the above difficulties, end seals, which comprise a considerably thinner sheet of semi-rigid plastic material, such as polytetrafluoroethylene (PTFE, TEFLON®) have been developed. To establish a satisfactory seal against all surfaces, an accurate fit of the Teflon® sheet to the surfaces is necessary. Consequently, great dimensional accuracy is necessary in the manufacture of both the Teflon® sheet and its holder. Careful handling of the Teflon® sheet and a certain degree of skilfulness of the fitter are necessary to provide exact positioning when mounting the end seal. One more problem is the fact that there is a risk of folds forming in the Teflon® sheet when being applied against the roller. In case of folds, ink or the like will leak out of the chamber.

The problem of leakage caused by folding can be compensated for by letting an end seal comprise two or more spaced-apart thin sealing sheets to form a so-called labyrinth packing. An end seal of this kind, which in fact functions well in practice, is disclosed in DE-U-94 05 883.

A problem of end seals which comprise a plurality of thin sheets made of e.g. Teflon®, however, resides in a more complicated construction. The fact that the end seal consists of many parts and comprises a plurality of Teflon® sheets also means that it will be expensive. Moreover, today's quick-drying inks will have time to dry in the gap forming between the sealing sheets in the application against the roller, which means that the labyrinth effect will partly be lost.

SUMMARY OF THE INVENTION

In view hereof, the object of the present invention is to provide an end sealing device which is improved in relation to prior-art and which at least partly solves the above problems.

This object is achieved on the one hand by means of a device having the features recited in independent claim 1 and, on the other hand, by means of a chambered doctor blade having the features as defined in claim 20.

Additional distinguishing features and advantages of the invention are apparent from the dependent claims and the following description.

By the end seal according to the invention comprising two sealing sheets of which the first and the second sealing sheet are mutually arranged to seal against different portions of the inside of the space which is defined by the chambered doctor blade and the cylinder and which may contain ink or the like, a plurality of inconveniences caused by prior-art technique can be obviated. The first sealing sheet seals against the inside of the frame of the chambered doctor blade which in the operative position of the chambered doctor blade is essentially stationary, while said sealing sheet is located at a distance from the circumferential surface of the movable cylinder. The second sealing sheet seals against the doctor blades and, in the operative position of the chambered doctor blade, against the circumferential surface of the movable cylinder. Each sealing sheet thus need not seal against the inside of the space along its entire circumference. This means that the requirements as to dimensional accuracy will be lower, which enables lower costs in connection with the manufacture of the sealing sheets. Moreover the mounting work is facilitated since the accuracy need not be very high.

One more advantage of the inventive end seal is that, for example, the material and thickness of the sealing sheets can be optimised based on the requirements placed on the respective sheets. Thus, for example materials for the first sealing sheet, which preferably seals against essentially stationary parts in the printing unit, can be selected independently of the material which is considered suitable for the second sheet, which seals against the doctor blades and the movable cylinder.

The first sealing sheet is not subjected to mechanical wear to the same extent as the second sheet. The inventive end sealing allows that only the second sheet be exchanged.

By letting the second sealing sheet have a sealing lip projecting relative to the first sealing sheet and adapted to be applied against the circumferential surface of the cylinder, there is a decreased risk of the first sealing sheet contacting the circumferential surface of the cylinder also when the doctor blades have been worn down.

Thanks to the sealing lip, applicable against the cylinder, of the second sealing sheet being adapted to be curved over an edge surface, facing the cylinder, of the first sealing sheet, the pliability of the second sealing sheet relative to the cylinder is improved by obtaining an elastic support from the first sealing sheet. Moreover the first sealing sheet is protected from contacting the movable parts of the construction, which means that it is not subjected to a considerable degree of mechanical wear. Furthermore owing to the curve of the sealing lip, a satisfactory seal against the circumferential surface of the cylinder is maintained also if the sealing lip is worn.

By forming, according to a preferred embodiment, a recess in the sealing lip of the second sealing sheet so as to give the sealing lip a curved shape, better application against the circumferential surface of the cylinder and, thus, a more efficient sealing function are rendered possible. Furthermore the risk of folding of the sealing sheet can be eliminated. The mechanical wear on the second sealing sheet can be reduced by letting the recess of the sealing lip have a radius of curvature corresponding to the radius of the cylinder.

Preferably, the edge surface, facing the cylinder, of the first sheet is allowed to have a radius of curvature corresponding to that of the sealing lip of the second sealing sheet, thereby achieving improved cooperation between the sealing sheets.

The fact that the second sealing sheet, in the operative position of the chambered doctor blade, seals essentially merely against the movable parts of the construction, i.e. against the circumferential surface of the cylinder and a portion, closest to the cylinder, of each doctor blade; means that the application against the cylinder causes a "single curve" of the sheet. This minimises the risk of folding of the sheet, and leakage of ink or the like through the end seal can be prevented.

Owing to the fact that the edges of the first sealing sheet are located at a distance from the portions against which the second sealing sheet seals, the risk is minimised that dried ink or the like is accumulated under the wiping doctor blade and thus deteriorates its function.

The preferably plane sealing sheets advantageously abut against each other for improved cooperation.

An advantage of making the first sealing sheet of a compressible material is that a satisfactory seal against the inside of the chamber can be established even if the dimensions of the sheet are not exact. Consequently, this means lower requirements as to dimensional accuracy in manufacture and accuracy in the mounting work.

The first sealing sheet is advantageously made of a foamed polymer material, for instance polyethylene, thereby keeping down the costs of the end sealing.

An advantage of making the second sealing sheet, which seals against the-circumferential surface of the cylinder and the portion, closest to the cylinder, of each doctor blade, of a yieldable and semi-rigid material is that the sheet can be made thin. Yieldable materials permit preforming of the sealing sheet for an improved sealing function. Such preforming can, for example, be made manually. If the sheet is preformed, the risk of leakage owing to folding can be further reduced. Moreover, mechanical wear on a suitably selected yieldable material usually occurs more slowly than on, for instance, a compressible material.

If the second sealing sheet is made of a polymer material, preferably polytetrafluoroethylene (PTFE, for instance TEFLON®), a wear-resistant and formable sheet is obtained for sealing abutment against the circumferential surface of the cylinder and against the portion, closest to the cylinder, of each doctor blade.

If a first sealing sheet is selected, which in a preferred embodiment is considerably thicker, about 3–35 times, than the second sealing sheet, improved cooperation between the two sealing sheets is rendered possible since the first sheet affords the second sheet a better support.

An advantage of letting the first sealing sheet be relatively thick, about 3–15 mm and preferably about 5 mm, is that it allows improved sealing against the essentially stationary parts of the chambered doctor blade since the abutment surfaces will be greater and the risk of folding decreases.

By making the second sealing sheet as a thin sheet or foil, having a thickness of less than below about 1.1 mm and preferably 0.3–0.6 mm, it merely occupies a smaller area of a small extent in the longitudinal direction of the cylinder. This minimises the risk of deterioration of the sealing of the doctor blades against the cylinder caused by ink or the like accumulating behind the wiping doctor blade. Also the force applied by the second sealing sheet to the doctor blade is minimised, which results in less wear on the doctor blade at the end sealing.

An advantage of letting the holding means of the end seal being designed in such manner that the sealing sheets can be clamped against each other is that improved cooperation between the sealing sheets is achieved. Furthermore a simple construction of the end sealing device with a small number of elements is obtained, which facilitates, for instance, cleaning thereof.

BRIEF DESCRIPTION OF THE DRAWINGS

The invention and its advantages will now be described in more detail with reference to the accompanying schematic drawings which by way of example illustrate a currently preferred embodiment.

DESCRIPTION OF A PREFERRED EMBODIMENT

Figure 1:
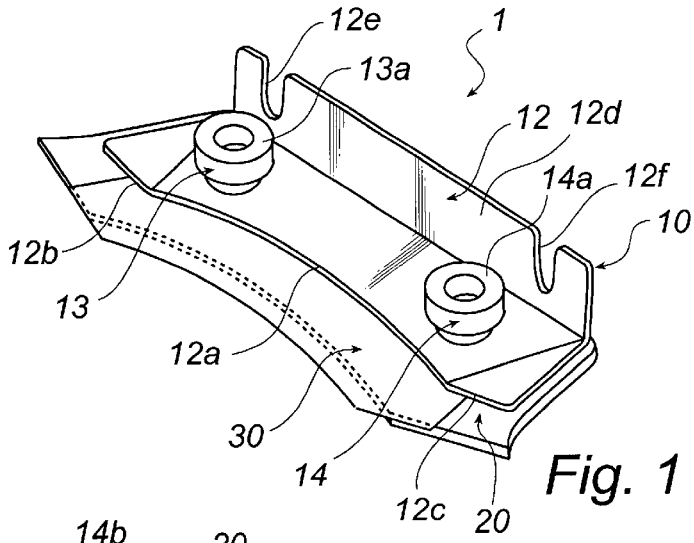
FIGS. 1 and 2 are perspective views of the end sealing device according to the invention.
Figure 2:
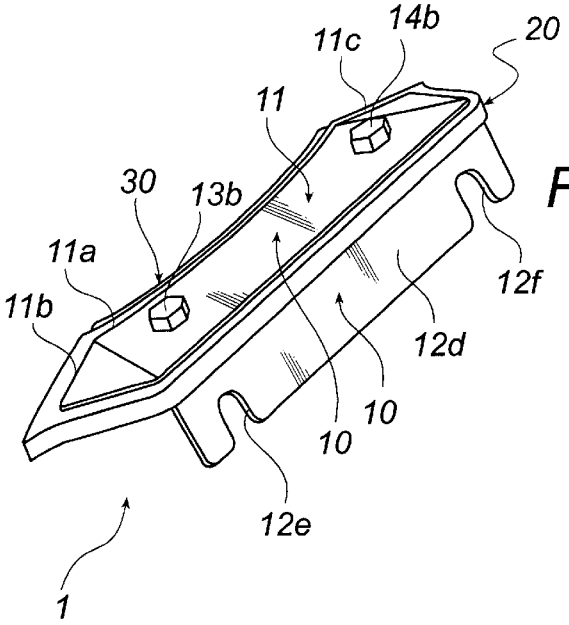
Figure 3:
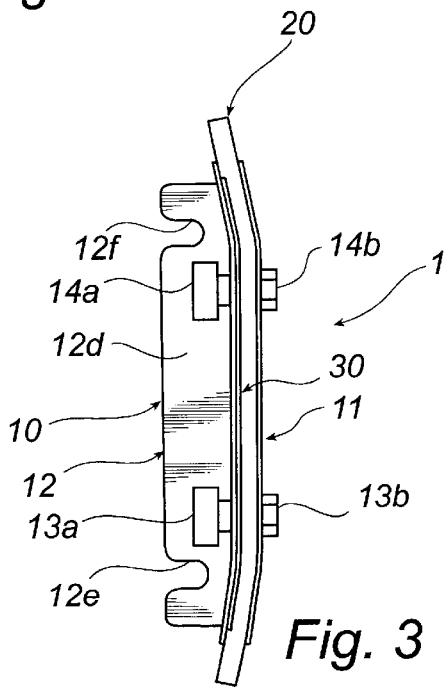
FIG. 3 is a side view of the device.

An end sealing device 1 according to a preferred embodiment of the invention is shown in FIGS. 1–3. The end seal 1 comprises a holding means 10 and a sealing means 20, 30 consisting of a first sealing sheet 20 and a second sealing sheet 30. As is apparent from FIGS. 1–3, the holding means 10 comprises a first and a second holding element 11, 12 which are held together by clamping means 13, 14 consisting of nuts 13*a*, 14*a* of e.g. plastic, and screws 13*b*, 14*b* preferably made of metal. The holding elements 11, 12 are preferably made of metal. The preferably plane sealing sheets 20, 30 abutting against each other are arranged between and squeezed by the two holding elements 11, 12 of the holding means 10.

Figure 7:
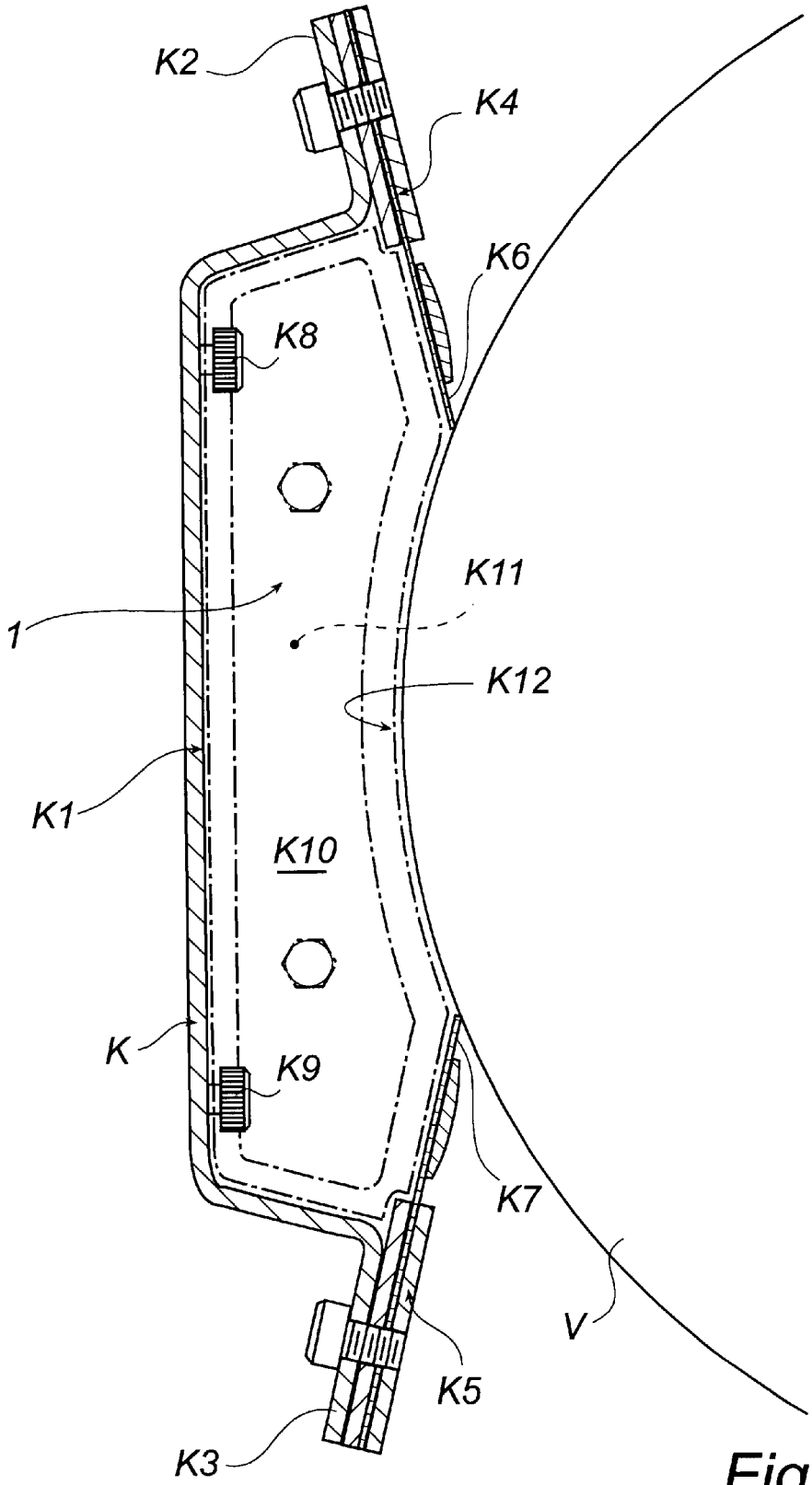
FIGS. 7 and 8 are schematic views of a chambered doctor blade in which the end sealing device can be used.
Figure 8:
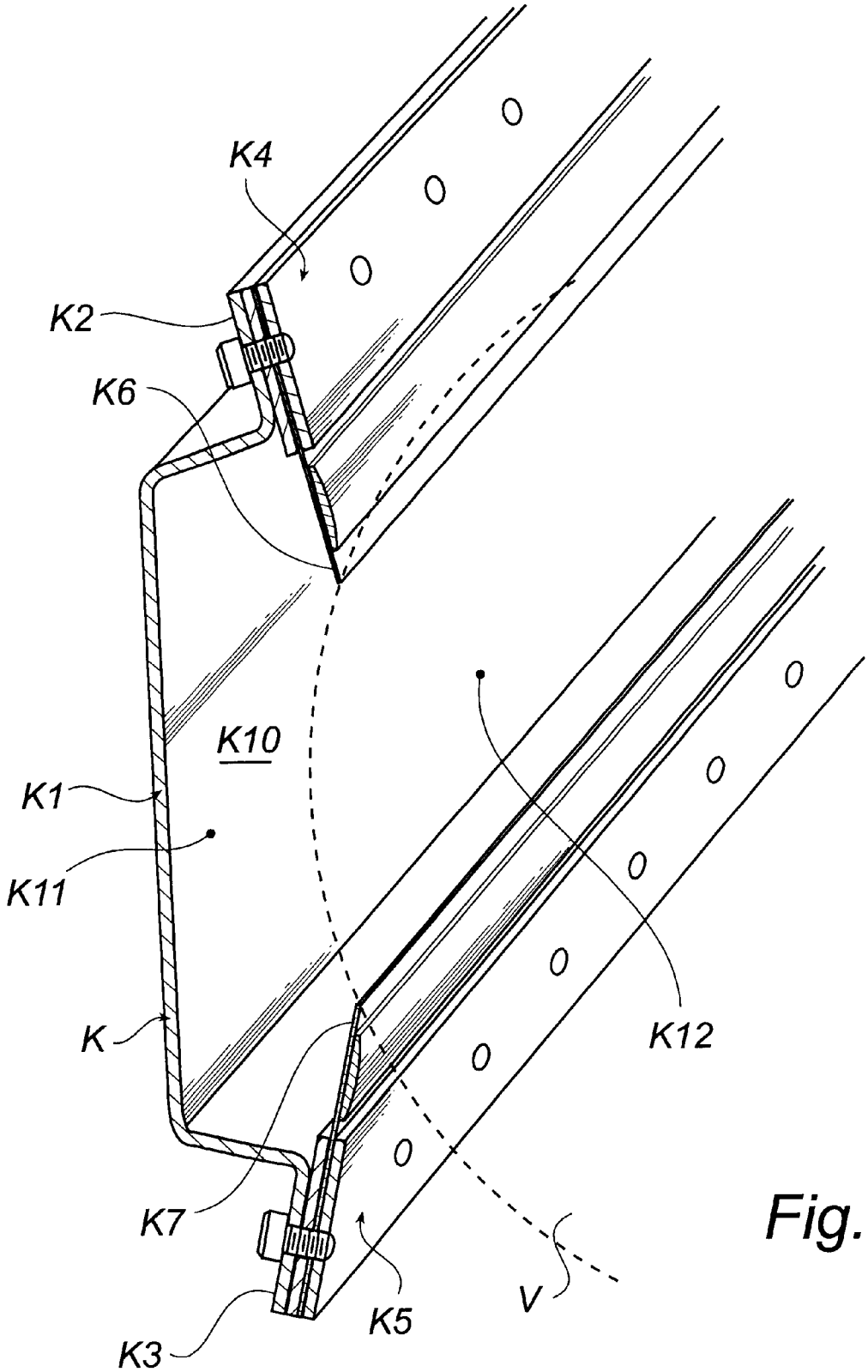

The end seal 1 is intended for end sealing of a chambered doctor blade device of the type shown in FIGS. 7 and 8 and intended for a printing unit. In FIG. 7 dashed lines schematically indicate how an end seal 1 is inserted into the end of an elongate chambered doctor blade K, which is arranged adjacent to a rotatable cylinder V included in a printing unit, in such manner that its longitudinal axis is parallel with the longitudinal axis of the cylinder V. The chambered doctor blade K comprises an elongate frame K1 which is essentially U-shaped in cross-section, with outwardly directed flanges K2, K3, on which two elongate doctor blades K6, K7 are mounted by means of doctor blade holders K4, K5 of a type known per se. The frame K1 and the doctor blades K6, K7 define a chamber K10 which is trapezoidal in cross-section and which has an essential trapezoidal opening K11 in each end. The end seal 1 is adapted to be mounted on the chambered doctor blade K in the opening K11 in order to sealingly close the same. The chamber K10 which may contain liquid, such as ink, lacquer or adhesive, further has an essentially rectangular opening K12 which is partly defined by the doctor blades K6, K7 (see FIG. 8) . In its operative position, the chambered doctor blade K is applied against the cylinder V with the elongate opening K12 facing the circumferential surface of the cylinder V for application of, for example, ink on the circumferential surface.

As is evident from FIG. 2, the first holding element 11 is essentially trapezoidal with a recess 11*a* having a radius of curvature, and has two bevelled corners 11*b*, 11*c*.

As is evident from e.g. FIG. 1, the second holding element 12 resembles the first holding element 11 and is trapezoidal with a recess 12*a* having a radius of curvature and has two bevelled corners 12*b*, 12*c*. The holding element 12 in addition has an upright flange 12*d* with recesses 12*e*, 12*f* for engagement with clamping screws K8, K9 on the chambered doctor blade K (see FIG. 7).

As shown in FIGS. 1 and 2, the sealing sheets 20, 30 have portions which extend outside the holding means 10 and which are adapted to be sealingly applied against the inside of the frame K1 of the surrounding chambered doctor blade K, the doctor blade holders K4, K5, the doctor blades K6, K7 and the circumferential surface of the cylinder V between the doctor blades K6, K7.

Figure 4:
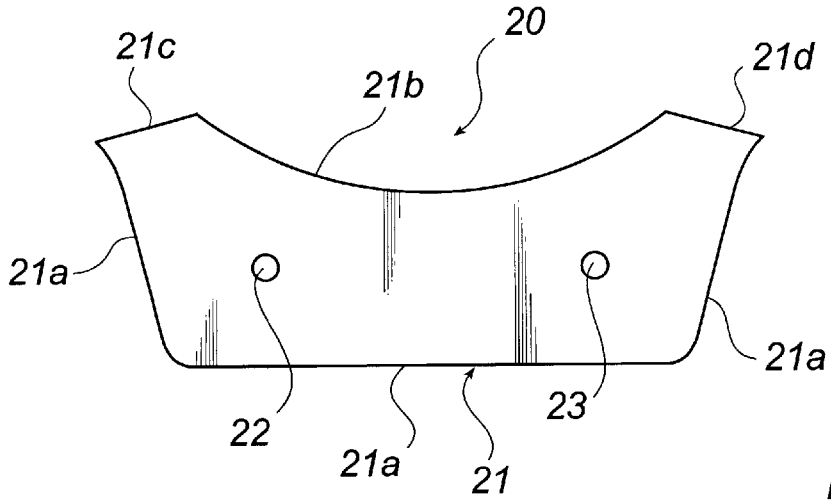
FIG. 4 is a top plan view of the first sealing sheet included in the device.

The first sealing sheet 20 (see FIG. 4), which is adapted, when mounted in the opening K11 of the chambered doctor blade K, to face the chamber K10 containing e.g. ink, is preferably made of a foamed polymer material, such a polyethylene, and is preferably about 5 mm thick.

Moreover the sealing sheet 20 is essentially trapezoidal with two opposite long sides or bases and two opposite, inclined, non-parallel sides, and has a circumferential edge 21 divided into four edge portions 21*a–d*. The first edge portion 21*a* is U-shaped and comprises the shorter base or long side of the trapezoid and its two non-parallel sides and is adapted to seal against the inside of the frame K1 of the chambered doctor blade K. The sealing sheet 20 has an opposite, second curved edge portion 21*b*, which is adapted, in the operative position of the chambered doctor blade K, to be located at a distance from the cylinder v and from a portion, closest to the cylinder V, of each doctor blade K6, K7. Moreover, the third and fourth edge portions 21*c*, 21*d* of the sealing sheet 20, corresponding to the bevelled corners of the sheet 20, are adapted to seal, from the inside, against each doctor blade holder K4, KS and against a portion, furthest away from the cylinder V, of each doctor blade K6, K7. The third and fourth circumferential edge portions 21*c*, 21*d* of the first sealing sheet 20 are adapted, in the operative position of the chambered doctor blade K, to be located at a distance from a portion, closest to the cylinder V, of each doctor blade K6, K7. The sealing sheet 20 is formed with two apertures 22, 23 for the screws 13*b*, 14*b* (see FIGS. 1–3).

Figure 5:
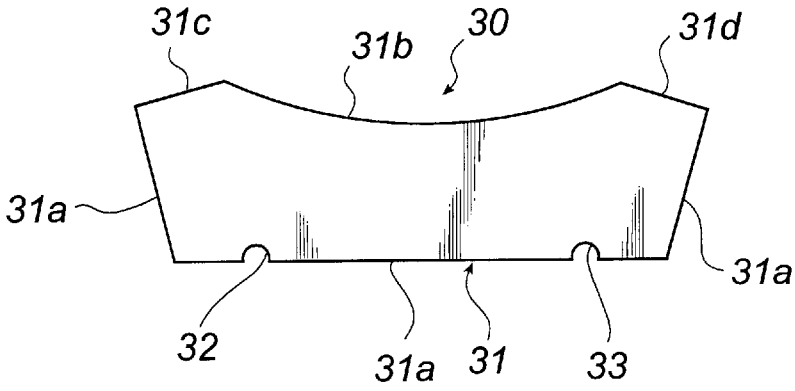
FIG. 5 is a top plan view of the second sealing sheet included in the device.

The second sealing sheet 30 (see FIG. 5), which is adapted, when mounted adjacent to the chambered doctor blade K, to face away from the chamber K10, is preferably e designed as a foil, about 0.4 mm thick, of a semi-rigid, yieldable material, such as polytetrafluoroethylene (TEFLON®).

Furthermore, the sealing sheet 30 is essentially trapezoidal, with two opposite long sides or bases and two opposite, inclined non-parallel sides, and has a circumferential edge 31 divided into four edge portions 31*a–d*. The first edge portion 31*a* is U-shaped and comprises the shorter base or long side of the trapezoid and its two non-parallel sides and is adapted to be located at a distance from the frame K1 of the chambered doctor blade K. The sealing sheet 30 has an opposite, second curved edge portion 31*b*, which is adapted, in the operative position of the chambered doctor blade K, to seal against the circumferential surface of the cylinder V. Moreover, the third and fourth edge portions 31*c*, 31*d* of the sealing sheet 30, corresponding to the bevelled corners of the sheet, are adapted to be located at a distance from the doctor blade holders K4, K5, and from a portion, furthest away from the cylinder V, of each doctor blade K6, K7. Furthermore, the edge portions 31*c*, 31*d* are adapted, in the operative position, to seal against the inside of a portion, closest to the cylinder V, of each doctor blade K6, K7.

The second sealing sheet 30 is formed with two recesses 32, 33 for abutment against the screws 13*b*, 14*b* (see FIGS. 1–3). The recesses 32, 33 make it possible, in a quick and easy manner, to remove and reinsert, alternatively exchange the second sealing sheet 30 since this can be carried out by merely partially loosening the clamping means 13, 14 without necessitating dismounting of the entire holding means 10.

Figure 6:
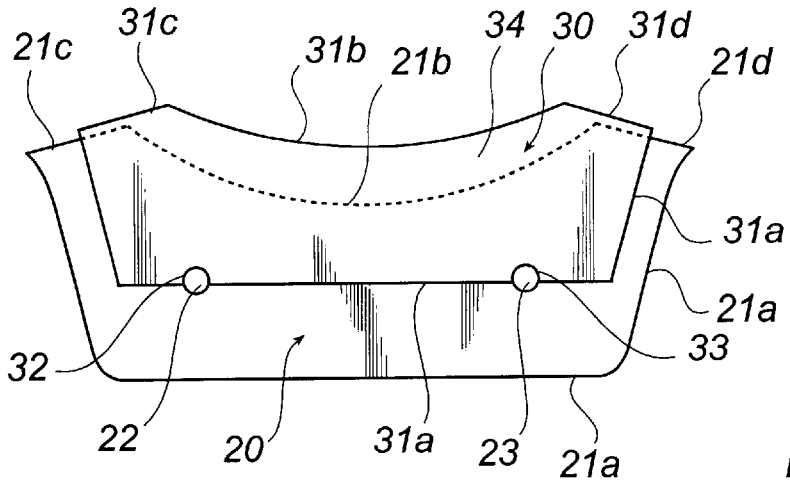
FIG. 6 shows how the sealing sheets are arranged relative to each other.

The manner in which the sealing sheets 20, 30 are arranged relative to each other and how they are arranged in the holding means 10 according to the preferred embodiment of the invention is illustrated in, for example, FIGS. 3 and 6. FIG. 6 shows that the sealing sheets 20, 30 partially overlap each other. The second sealing sheet 30 extends at its longest long side, alongside the edge portion 31*b*, outside the first sealing sheet 20 to form a sealing lip 34. In the operative position of the chambered doctor blade K, the lip 34, whose recess is curved with a radius of curvature essentially corresponding to that of the cylinder V, abuts sealingly against the circumferential surface of the cylinder V. The sealing lip 34 can, when applied against the circumferential surface of the cylinder V, be curved over one long side of the first sealing sheet 20 at the second, curved edge portion 21*b* thereof and the edge surface thereof facing the circumferential surface of the cylinder V. Furthermore, the radius of curvature of the sealing lip 34 is adjusted in such manner that the second sealing sheet, in a position applied against the circumferential surface of the cylinder V and curved over the first sealing sheet, obtains a curved shape with a radius of curvature which is essentially equal to the radius of the cylinder V. The lip 34 can advantageously be preformed, for instance manually, so as to curve over said edge surface of the sealing sheet 20 even before it is applied against the circumferential surface of the cylinder V. The radius of curvature of the recess of the sealing lip 34 approximately corresponds to the radius of curvature of the curved shape of said edge surface of the first sealing sheet 20. Where the edge portions 21*c* and 31*c* and respectively 21*d* and 31*d* overlap, the sheet 30 extends outside the sheet 20 by about 0–1 mm.

In the operative position of the chambered doctor blade K (see FIG. 7) in which the doctor blades K6, K7 are applied against the circumferential surface of the cylinder V, the sealing sheets 20, 30 extend essentially parallel with a plane transversely of the longitudinal axis of the chambered doctor blade K, i.e. in the plane of the drawing.

The invention has been described above with reference to an embodiment selected as an example, and variations and modifications are feasible within the scope of the invention. For instance, a sealing sheet may consist of a plurality of smaller sheets which are mounted in a suitable fashion in the holding means. It is also evident that the end seal with its holding means and sealing sheets can be made in other geometric shapes to fit into chambered doctor blade devices of a different type. It should be pointed out that it is possible to let the end seal comprise more than two sheets for an improved sealing function. It goes without saying that the holding means need not be made in two parts and can instead be provided with flanges between which the sealing means is arranged.

What is claimed is:

1. A device for end sealing of a chambered doctor blade (K), which chambered doctor blade (K) comprises an elongate frame (K1) and two elongate doctor blades (K6, K7) which are arranged in a spaced-apart relationship on the frame (K1) and define, together with the latter, an elongate chamber (K10), which is adapted to hold a liquid, such as ink, lacquer or adhesive, and which has an elongate opening (K12) to be applied, in an operative position of the chambered doctor blade, against a rotatable cylinder (V) included in a printing unit, said device comprising first and second sealing sheets (20, 30) which are insertable into an opening (K11) in one end of said chamber (K10) and mountable to at least partially overlap each other and sealingly close said opening (K11), characterised in that the second sealing sheet (30) is arranged relative to the first sealing sheet (20) in such manner that the second sealing sheet (30) is sealingly applicable against said doctor blades (K6, K7) and, in the operative position of the chambered doctor blade (K), abuts against a circumferential surface of said cylinder (V) and in such manner that the first sealing sheet (20) is sealingly applicable against said frame (K1) and, in the operative position of the chambered doctor blade (K), is located at a distance from said circumferential surface, and the second sealing sheet (30) has a sealing lip (34) Which projects relative to the first sealing sheet (20) and is designed to be curved, in the operative position of the chambered doctor blade (K), over an edge surface, facing the cylinder (V), of the first sealing sheet (20) and sealingly abut against the circumferential surface of the cylinder (V).

2. A device as claimed in claim 1, wherein the sealing lip (34) has an edge portion (31*b*) with a radius of curvature essentially corresponding to the radius of the cylinder (V).

3. A device as claimed in claim 2, wherein the second circumferential edge portion (31*b*) of the second sealing sheet (30) is located on the sealing lip (34).

4. A device as claimed in claim 1, wherein said edge surface of the first sealing sheet (20) has a radius of curvature which approximately corresponds to the radius of curvature of the sealing lip (34).

5. A device as claimed in claim 1, wherein the first sealing sheet (20) has a first circumferential edge portion (21*a*) which is adapted to seal against the inside of the frame (K1), and an opposite second circumferential edge portion (21*b*) which, in the operative position of the chambered doctor blade, (K) is located at a distance from the cylinder (V), and wherein the second sealing sheet (30) has a first circumferential edge portion (31*a*) which is adapted to be located at a distance from the inside of the frame (K1), and an opposite second circumferential edge portion (31*b*) which is adapted, in said operative position, to seal against the circumferential surface of the cylinder (V).

6. A device as claimed in claim 5, wherein the first sealing sheet (20) further has third and fourth circumferential edge portions (21*c*, 21*d*) which in a spaced-apart relationship are located one on each side of said second circumferential edge portion (21*b*) and which are adapted to seal against a portion, closest to the frame (K1), of each doctor blade (K6, K7), and wherein the second sealing sheet (30) further has third and fourth circumferential edge portions (31*c*, 31*d*) which in a spaced-apart relationship are located one on each side of said second circumferential edge portion (31*b*) and which are adapted to seal against a portion, in said operative position closest to the cylinder (V), of each doctor blade (K6, K7).

7. A device as claimed in claims 6, wherein the third and fourth circumferential edge portions (21*c*, 21*d*) of the first sealing sheet (20) are adapted to be located, in said operative position, at a distance from a portion, closest to the circumferential surface of the cylinder (V), of each doctor blade (K6, K7), and wherein the third and fourth circumferential edge portions (31*c*, 31*d*) of the second sealing sheet (30) are adapted to be located at a distance from a portion, closest to the frame (K1), of each doctor blade (K6, K7).

8. A device as claimed in claim 1, wherein the first sealing sheet (20) is designed to be mounted facing the chamber (K10), and wherein the second sealing sheet (30) is designed to be mounted facing away from the chamber (K10).

9. A device as claimed in claim 1, wherein the first and second sealing sheets (20, 30) are essentially plane and abut against each other.

10. A device as claimed in claim 1, wherein the first sealing sheet (20) is made of a compressible material.

11. A device as claimed in claim 1, wherein the first sealing sheet (20) is made of a foamed polymer material.

12. A device as claimed in claim 1, wherein the second sealing sheet (30) is made of a yieldable material.

13. A device as claimed in claim 1, wherein the second sealing sheet (30) is made of a polymer material.

14. A device as claimed in claim 13, wherein said polymer material comprises polytetrafluoroethylene.

15. A device as claimed in claim 1, wherein the first sealing sheet (20) is about 3–35 times thicker than the second sealing sheet (30).

16. A device as claimed in claim 1, wherein the first sealing sheet (20) has a thickness of about 3–15 mm.

17. A device as claimed in claim 16, wherein said first sealing sheet (20) has a thickness of about 5 mm.

18. A device as claimed in claim 1, wherein the second sealing sheet (30) has a thickness which is less than about 1.1 mm.

19. A device as claimed in claim 18, wherein said second sealing sheet (30) has a thickness which is about 0.3–0.6 mm.

20. A device as claimed in claim 1, wherein said opening (K11) in one end of the chamber (K10) is essentially trapezoidal, the two sealing sheets (20, 30) also being essentially trapezoidal with two opposite long sides and two opposite, inclined short sides, and wherein a long side of each sealing sheet (20, 30) defines said edge surface and said sealing lip (34), respectively.

21. A device as claimed in claim 1, further comprising a holding means (10) which comprises two holding elements (11, 12) which are adapted to be clamped together and between which the sealing sheets (20, 30) are adapted to be releasably clamped to each other.

22. A device as claimed in claim 21, wherein the second sealing sheet (30) is mounted in the holding means (10) so as to be easily exchangeable.

23. A chambered doctor blade for printing units, characterized in that it has at least one end sealing device as claimed in claim 1.

* * * * *